US008997440B2

(12) United States Patent
Carlson et al.

(10) Patent No.: US 8,997,440 B2
(45) Date of Patent: Apr. 7, 2015

(54) MANUALLY-ASSISTED VOID-FILL DUNNAGE DISPENSING SYSTEM AND METHOD

(75) Inventors: Daniel L. Carlson, Ravenna, OH (US); Timothy A. Frederick, Eastlake, OH (US); Joseph J. Harding, Mentor, OH (US); Kevin W. Park, Chardon, OH (US)

(73) Assignee: Ranpak Corp., Concord Township, OH (US)

( * ) Notice: Subject to any disclaimer, the term of this patent is extended or adjusted under 35 U.S.C. 154(b) by 965 days.

(21) Appl. No.: 13/125,318

(22) PCT Filed: Nov. 22, 2009

(86) PCT No.: PCT/US2009/065428

§ 371 (c)(1),
(2), (4) Date: Apr. 21, 2011

(87) PCT Pub. No.: WO2010/060000

PCT Pub. Date: May 27, 2010

(65) Prior Publication Data

US 2011/0197550 A1 Aug. 18, 2011

Related U.S. Application Data

(60) Provisional application No. 61/117,476, filed on Nov. 24, 2008.

(51) Int. Cl.

| | |
|---|---|
| ***B65B 23/00*** | (2006.01) |
| ***B65B 59/02*** | (2006.01) |
| ***B65B 55/20*** | (2006.01) |
| ***B31D 5/00*** | (2006.01) |

(52) U.S. Cl.

CPC ..... *B65B 55/20* (2013.01); *B31D 5/0047* (2013.01); *B31D 2205/0035* (2013.01); *B31D 2205/007* (2013.01); *B31D 2205/0088* (2013.01); *Y10S 493/967* (2013.01)

(58) Field of Classification Search

USPC ..... 53/503, 504, 52, 115; 702/173; 493/967, 464

See application file for complete search history.

(56) References Cited

U.S. PATENT DOCUMENTS

| | | | |
|---|---|---|---|
| 6,676,589 | B2 | 1/2004 | Kung et al. |
| 6,877,297 | B2 * | 4/2005 | Armington et al. ..... 53/502 |

(Continued)

FOREIGN PATENT DOCUMENTS

| | | |
|---|---|---|
| WO | 2007/115256 | 10/2007 |
| WO | 2009/123919 | 10/2009 |

OTHER PUBLICATIONS

International Search Report and Written Opinion of corresponding International Application No. PCT/US2009/065428, dated May 10, 2010.

*Primary Examiner* — Hemant M Desai
*Assistant Examiner* — Praachi M Pathak
(74) *Attorney, Agent, or Firm* — Renner, Otto, Boisselle & Sklar, LLP

(57) ABSTRACT

A packaging system (100) includes a controller (102), an input device (104) in communication with the controller (102) that identifies one or more characteristics of the container, an illustration with indicia representing different degrees of fill for a container; and a manual input device (106) in communication with the controller (102) for inputting an estimated degree of fullness of the packing container having one or more articles to be packed correlated with the indicia in the illustration. The controller (102) provides an output signal indicating a quantity of dunnage to dispense to the container based on the input estimated degree of fullness and the one or more identified characteristics of the container. Then the controller can determine the amount of dunnage that needs to be provided to fill the remaining void in the container, and the controller can signal a dunnage dispenser (110) to dispense the determined amount of dunnage.

11 Claims, 5 Drawing Sheets

(56) References Cited

U.S. PATENT DOCUMENTS

| | | | | |
|---|---|---|---|---|
| 7,050,938 | B1 * | 5/2006 | Prater et al. | 702/182 |
| 7,313,460 | B1 * | 12/2007 | Prater et al. | 700/213 |
| 7,337,595 | B2 * | 3/2008 | Harding | 53/504 |
| 7,751,929 | B1 * | 7/2010 | Prater et al. | 700/227 |
| 2005/0050848 | A1 * | 3/2005 | Harding | 53/58 |
| 2008/0092488 | A1 | 4/2008 | Gabrielsen et al. | |
| 2009/0173040 | A1 * | 7/2009 | Carlson et al. | 53/250 |
| 2010/0089011 | A1 * | 4/2010 | Armington et al. | 53/472 |

* cited by examiner

MANUALLY-ASSISTED VOID-FILL DUNNAGE DISPENSING SYSTEM AND METHOD

This application is national phase of International Application No. PCT/US2009/065428, filed Nov. 22, 2009, and published in English as WO 2010/060000, on May 27, 2010, which claims the benefit of U.S. Provisional Patent Application No. 61/117,476 filed Nov. 24, 2008, which are incorporated in their entirety by this reference.

FIELD OF THE INVENTION

The present invention is directed to a packing device, system and method for dispensing an appropriate amount of void-fill dunnage to fill a void in a container.

BACKGROUND

In the process of packing one or more objects in a container for shipment, a void-fill dunnage product typically is placed in the shipping container along with the objects. The dunnage partially or completely fills the empty space around the objects in the container to prevent or minimize damage that could be caused by the objects moving within the container during the shipping process. Some commonly used void-fill dunnage materials include plastic foam peanuts, plastic bubble wrap, airbags, and paper dunnage.

Typically, a packer looks into a container in which one or more objects have been placed for shipment and determines the amount of dunnage material needed to fill the remaining void in the container. The packer then controls a dunnage dispenser to dispense the desired amount of dunnage. For strip-like dunnage products, for example, many experienced packers can quickly determine how many and what lengths of dunnage strips are needed to fill the void in the container.

An inexperienced packer, however, has more difficulty efficiently determining what lengths and what number of strips of dunnage are needed to fill the void volume. Consequently an inexperienced packer can slow the packing process, and is less efficient than an experienced packer. Specifically, this means that the inexperienced packer is more likely to dispense too much or too little dunnage and then expend additional time and effort to correct this problem, while also potentially wasting lengths of dunnage.

To avoid such problems with manual packing systems, fully automated systems have been developed to both automatically measure the void volume in a container and then automatically determine the required amount of dunnage for the packer. In some cases these systems remove the need for a packer altogether and also automatically dispense dunnage to the container. The initial cost of such a fully automated system, however, generally is greater than that for a manual packer-operated system.

SUMMARY

The present invention provides an inexpensive solution to the inexperienced packer problem while providing appropriate amounts of void-fill dunnage for a wide variety of container sizes and packed-object configurations.

An exemplary method according to the invention includes the step of manually indicating an estimated relative degree to which a container is filled by one or more objects to be packaged. The method also includes the steps of identifying one or more characteristics of a container, and providing an output signal indicating the quantity of dunnage to dispense to the container based on the estimated fullness and the one or more characteristics of the container.

Even an inexperienced packer can look at a container having one or more objects placed therein for shipping and estimate the relative degree to which the container is filled. A controller then can determine the quantity of dunnage to dispense to fill the void in the container based on the container characteristic and the estimated relative degree of fullness. Since void-fill dunnage typically has resilient properties that enable it to be slightly compressed without destroying its intended function, and since the void-fill dunnage does not need to fill the void completely to adequately perform its intended function, the packer's estimated degree of fill typically is sufficient for the controller to determine an adequate amount of dunnage.

More particularly, the present invention provides a method for controlling an amount of dunnage to be dispensed to a packing container. The method includes the steps of (i) identifying one or more characteristics of a container where one or more articles are placed in the shipping container, (ii) manually inputting an estimated degree of fullness for the container, and (iii) providing an output signal indicating a quantity of dunnage to dispense to the container based on the estimated degree of fullness and the one or more identified characteristics of the container.

The present invention also provides a device for controlling an amount of dunnage to be dispensed to a packing container with one or more objects. The device includes a container input device to identify one or more characteristics of a packing container, an illustration of different degrees of fill for a container, a manual input device for inputting an estimated degree of fullness of the packing container having one or more articles to be packed correlated with the illustration, and a controller in communication with the container input device and the manual input device. The controller determines the quantity of dunnage to dispense to the container based on the input estimated degree of fullness and the input container identity.

A packaging system provided by the present invention includes means for manually inputting a relative degree to which a container is filled by one or more products to be packaged, means for identifying one or more characteristics of a container, and means for outputting a signal indicating the quantity of dunnage to dispense based on the manually input relative degree of fill and the identified characteristics of the container.

The present invention further provides a method for determining a height dimension of a packing container having a flap secured to an upper edge of a side wall of the container. The method includes the steps of positioning a flap at an angle relative to the corresponding side wall, and directing a sensor beam parallel to the side wall to measure an approximate height dimension of the side wall. The method can further include the step of outwardly displacing a distal end of the flap.

The present invention also provides a system for determining an approximate height dimension of a packing container having a flap secured to an upper edge of a side wall of the container. The system includes (a) a registration device against which a vertical side of a container can be registered, (b) a sensor positioned adjacent the registration device to direct a sensor beam parallel to the side wall to measure a vertical distance from a known position to an outwardly-displaced flap connected to an upper edge of a side wall of the container, and (c) a controller for determining a height of the container based on the measured vertical distance.

Another packaging system provided by the present inventing includes a packaging station having a scale to weigh a container at the packaging station, a dispenser to dispense dunnage to a container at the packaging station; and a controller to compare the weight of the container to a freight rate schedule that includes higher freight rates for heavier containers, both to determine how much less dunnage should be dispensed to reach a lower freight rate, and to output a signal representing the reduced amount of dunnage to a packer.

Another exemplary void-fill packaging system includes a manual input device for indicating an estimate of how full a container is, and a controller that provides an output signal that indicates how much dunnage to dispense to the container based on the estimate and one or more characteristics of the container.

The foregoing and other features of the invention are hereinafter fully described and particularly pointed out in the claims, the following description and the annexed drawings setting forth in detail several illustrative embodiments of the invention, such being indicative, however, of but a few of the various ways in which the principles of the invention may be employed.

DETAILED DESCRIPTION

The present invention provides an inexpensive solution to the problem of an inexperienced packer. Yet the present invention also provides a system that can supply an appropriate amount of void-fill dunnage for a wide variety of container sizes and product configurations. An inexperienced packer, even without knowing anything about the dunnage product being dispensed, can look at a container having one or more objects placed therein for shipping and can estimate the relative degree to which the container is filled. Once the characteristics of the container have been identified, either predetermined or detected in some manner, and the packer has indicated an estimated relative degree to which the container is filled, a controller can determine the quantity of dunnage to dispense to fill the void in the container. An expensive system that automatically measures the void volume in a container is not needed. Since void-fill dunnage typically has resilient properties that enable it to be slightly compressed without destroying its intended function, and since the void-fill dunnage does not need to fill the void completely to be effective, the packer's estimated relative degree of fill typically is sufficient for the controller to determine an adequate amount of dunnage. This system allows an inexperienced packer to effectively assist in determining the appropriate amount of dunnage to dispense, even when the packer has never performed the task before.

Briefly, the present invention provides a packaging system that includes means for manually inputting a relative degree to which a container is filled with one or more objects to be packaged, or means for manually selecting an input option from multiple input options, where the input options represent relative degrees to which a container is filled by one or more objects to be packaged. The packaging system also includes means for identifying one or more characteristics of the container, and means for providing an output signal indicating the quantity of dunnage to dispense to the container based on either the manually input estimated degree of fullness or the selected input option and the one or more identified characteristics of the container. To put it another way, the void-fill packaging system includes a manual input device for indicating an estimate of how full a container is, and a controller that provides an output signal that indicates how much dunnage to dispense to the container based on the estimate and one or more characteristics of the container.

Figure 1:
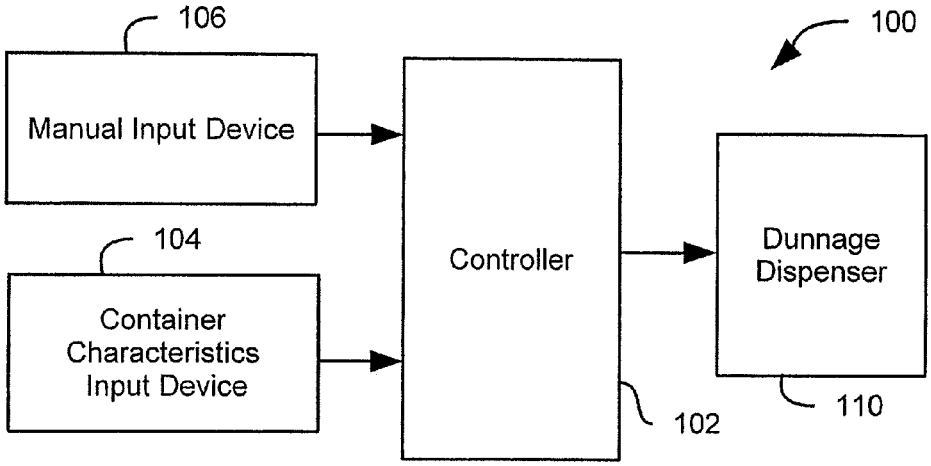
FIG. 1 is a schematic representation of a packaging system provided in accordance with the present invention.

Referring now to the drawings and initially to FIG. 1, the present invention provides a packaging system 100 that includes a controller 102, an input device 104 in communication with the controller 102 for identifying one or more characteristics of the container, and a manual input device 106 in communication with the controller 102 for inputting an estimated relative degree to which a container is filled by one or more objects to be packaged. The relative degree of fullness is an estimate or approximation of how full the container is, such as nearly empty, half full, and nearly full. As an equivalent alternative, the relative degree of fullness can be an estimate of the how much void volume remains in the container or how much dunnage is needed, i.e., a relative degree of emptiness (compare FIGS. 5 and 6; either one leads to the same result). The controller 102 provides an output signal indicating a quantity of dunnage to dispense to the container based on the indicated relative degree of container fullness estimate and the one or more identified characteristics of the container.

The container characteristics can include one or more of a container identifier, a size, shape, and/or one or more dimensions of the container, for example. The container identifier can include a barcode, name, number, color, radio frequency identification (RFID) or other indicia, for example, or any other device or method that can be used by the controller to identify the container and/or its unfilled or empty volume.

From the container characteristics information and the estimated relative degree to which the container is filled by the objects to be packaged, the controller 102 can determine the amount of dunnage that needs to be provided to fill the remaining void in the container. This can be accomplished in many ways. For example, once a container is identified, the controller 102 can determine the void volume when the container is empty, and then use the relative fullness estimate input by the packer to calculate how much of the determined empty void volume remains in the container that needs to be filled with dunnage. Since the approximate volume taken up by the dunnage is known, the controller 102 can calculate an amount of dunnage adequate to fill the void. The controller can either calculate the void volume or the controller can look the information up in one or more look-up tables. For each container, for example container sizes A, B, and C, the look-up table may include the appropriate amount of dunnage to dispense for an estimated container fullness. If only one container size is used with this system 100, the container characteristics can be predetermined, and can be input and stored in a memory.

Once the controller 102 has determined the amount of dunnage that needs to be dispensed, the controller can signal a dunnage dispenser 110 to dispense the determined amount of dunnage. Alternatively, the controller can output a signal that tells the packer how much dunnage to dispense and the packer can control the dispenser. For example, the controller could instruct the packer to dispense a particular volume or length of dunnage.

The controller 102 can be integrated into the dunnage dispenser 110, or can be remotely located relative to the dunnage dispenser 110, and can either control the dispenser 110 remotely or communicate the amount of dunnage to be dispensed to another controller that is integrated into the dispenser 110. A single controller can control multiple dispensers in this system.

Figure 2:
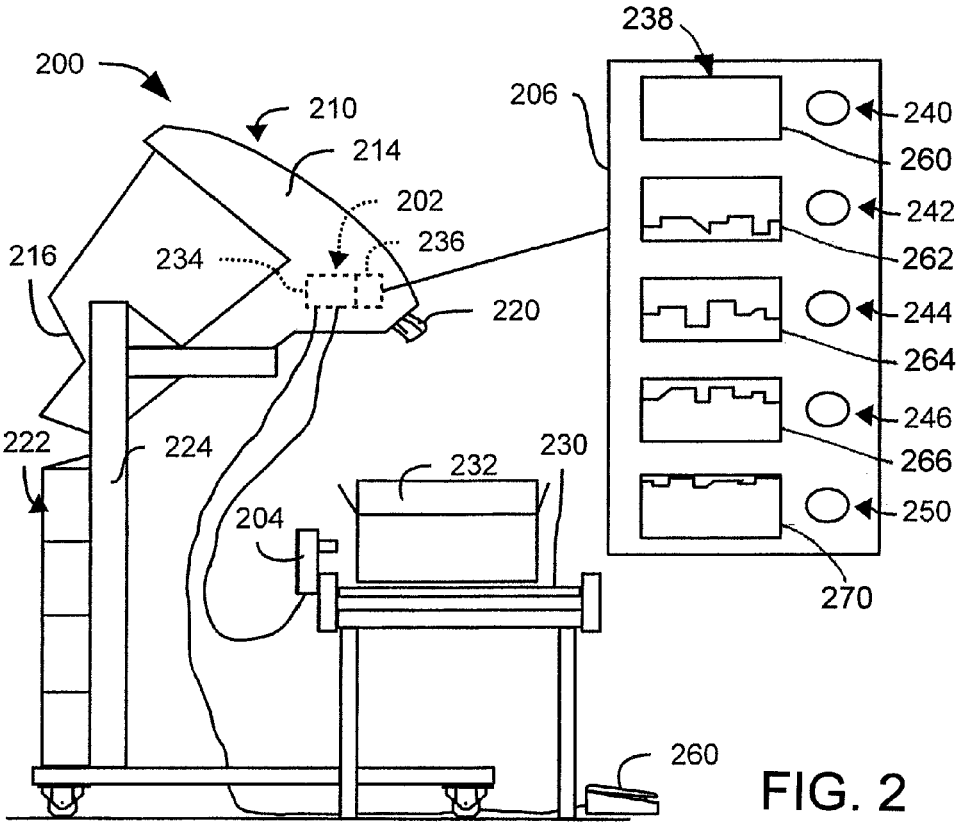
FIG. 2 is a schematic representation of a first exemplary packaging system provided in accordance with the present invention.

A first exemplary packaging system 200 provided in accordance with the present invention is illustrated in FIG. 2. The packaging system 200 includes a controller 202, and (i) a container characteristics input device 204, (ii) a manual input device 206, and (iii) a dunnage dispenser 210 to dispense a determined quantity of dunnage, each of which is in communication with the controller 202 to provide inputs or receive outputs from the controller 202. An exemplary dunnage dispenser 210 is a void-fill dunnage conversion machine 214 that converts a sheet stock material 216 into a thicker and relatively less dense void-fill dunnage product 220, such as the conversion machine disclosed in U.S. Pat. No. 6,676,589, which is hereby incorporated herein by reference. An exemplary supply 222 of sheet stock material includes a stack of fan-folded kraft paper, such as that shown mounted on a stand 224 for the conversion machine 214, or a roll of one or more plies of sheet stock material.

The dunnage conversion machine 214 is positioned at a packing station, for dispensing packaging material to a container 232. The packing station includes a packaging surface for supporting a container, such as a table or a conveyor. In the illustrated embodiment, the dunnage conversion machine 214 is positioned adjacent a conveyor 230. An exemplary container 232 is a cardboard box, typically in the form of either a rectangular slotted container (RSC) with inwardly folding flaps, or a shoebox-style container with a separate lid, so that the container 232 can be closed for shipment after the conversion machine 214 or other dunnage dispenser 210 dispenses a determined quantity of dunnage.

The controller 202 provides an output signal indicating the determined quantity of dunnage to dispense to the container based on a signal from the manual input device 206 and a signal from the container input device 204. The controller 202 in this embodiment is integral to the dunnage conversion machine 214 and not only determines the amount of dunnage to dispense but also signals the conversion components of the conversion machine 214 to produce the determined amount of dunnage. The controller 202 includes a processor 234 and a memory 236 for storing programming and data needed to determine the amount of dunnage to dispense and to control the dunnage dispenser 210 or elements thereof to dispense the determined amount of dunnage. The determined amount of dunnage can be expressed as the number of and the lengths of dunnage strips, a volume of dunnage, or a length of time to open a dispensing chute. The controller 202 determines the quantity of dunnage to dispense based on the container characteristics inputs and estimated relative degree of fullness inputs, as well as the per-unit volume of the dunnage. The per-unit volume of the dunnage can be expressed as a function of length, for example.

The container characteristics are input via the characteristics input device 204, which includes at least one of a barcode reader; one or more sensors to indicate dimensions of the container 232; a mechanical, optical or electromagnetic probe; a computer mouse or other pointing device; a touch screen display; a switch; a keypad; a push-button switch; a toggle switch; a foot switch; a rotary dial; a kneepad switch; a wireless remote control device; a radio frequency identification (RFID) reader; and a stylus and stylus-sensitive pad; or any other means for inputting and identifying one or more characteristics of a container. As noted above, the container input device 204 identifies the container 232, the dimensions of the container, its size, or other characteristics that will enable the controller 202 to determine the appropriate amount of dunnage to dispense.

The container characteristics can be input in many different ways, either manually by a packer or automatically, and either predetermined, input via the characteristics input device 204 and stored in the memory 236, or determined on an ongoing basis as each container is presented to the characteristics input device 204. One way to input the container characteristics includes reading a barcode, which the controller 202 will then look up in a look-up table stored in the memory 236. The look-up table can identify the amount of dunnage to dispense based on the barcode-identified container characteristics input and the manually-selected estimated degree of fullness input for that container. Alternatively, the controller 202 can determine the void volume of an empty container from the barcode or other container characteristic, and then determine how much of that void remains based on the estimated relative degree of fullness provided by the packer. If the system 200 is used with only one size of container, the empty volume of a container 232 can be predetermined and input one time. In this case, the empty volume can be stored in the controller memory 236 and recalled by the controller 202 when needed. Then the only input needed for the controller 202 to determine how much dunnage to dispense is the packer's estimate of how full the container is.

The manual input device 206 in this embodiment includes means for selecting or otherwise inputting an estimated relative degree to which a container is filled by one or more products to be packaged and an illustration 238 with one or more indicia correlated with the estimated relative degree of fullness. The manual input device 206 can include one or more of a microphone, a position sensor, a computer mouse or other pointing device, a touch screen, a keypad, a rotary dial, a push-button, a switch, a foot switch, a kneepad switch, a wireless remote control device, a toggle slider, a stylus and stylus-type sensitive pad, or any other means for inputting an estimated relative degree of fullness for a container.

In the illustrated embodiment, the manual input device 206 provides several discrete input options between empty and full. Typically, the manual input device 206 provides about two to about five discrete input options. Some input devices, however, can provide an infinite number of options, limited only by the sensitivity of the input device. A slider, for example, can provide a continuum of options between empty and full and the packer can move the slider to the position that best represents the relative degree to which the container is filled. The same type of input can be provided via a touch screen. Alternatively, the input can be provided by the number of times a switch is triggered, or by triggering a particular switch among a plurality of switches provided.

The manual input device 206 and the container characteristics input device 204 can be embodied in the same device. Accordingly, the packer could first read a box code into a microphone to identify the container and then input a selected estimate of the relative degree of fullness by speaking into the same microphone. The controller in that case can include voice recognition software to identify the words spoken and match them to known containers and degrees of fullness. Such a system can be calibrated for different users, such as at the beginning of each shift, by having the packer recite the available options.

Exemplary discrete input options include empty 240, 25% full 242, 50% full 244, 75% full 246, and full 250, which are shown in the illustrated embodiment in the illustration 238 with indicia 260, 262, 264, 266, and 270 in the form of graphical representations with corresponding means for selecting the desired input option, such as a push-button switch or designated area of a touch screen. Alternatively, the input options may forego including empty and full as options, since an empty container and a full container probably will not require dunnage. An empty container is likely to be an error or a fault condition that would require correction prior to dispensing dunnage to the container. A full container is a container that generally can be passed along for shipment without dispensing any dunnage material to the container.

Another alternative set of input options can include estimates of nearly empty, half full, and nearly full. These are all relative degrees of fill that an inexperienced packer could identify by looking into a container without having any prior experience in providing dunnage material to a container for shipment. Additionally, as noted above, the manual input device 206 can include a linearly-variable level indicator with settings between empty and full, such as the slider mentioned above. The controller 202 then can use the selected manual input and the container characteristics input to determine the amount of dunnage to dispense and instruct the conversion machine 214 to produce the determined amount of dunnage.

As a specific example, suppose a container when empty has a volume of 24,000 cubic centimeters. If the packer estimates that the objects in the container for shipment occupy about 70% of the container, the controller 202 can calculate that 7,200 cubic centimeters of dunnage are needed to fill the container. Knowing that the dunnage has a volume of 72 cubic centimeters per centimeter of length, the controller can then determine and output a signal to the conversion machine 214 to dispense 100 centimeters of dunnage to fill the 7,200 cubic centimeter void volume.

The dunnage conversion machine 214 or other dunnage dispenser can further include a dunnage dispensing input device 260, such as the illustrated foot switch, to manually dispense an additional amount of dunnage if the packer determines that the amount of dunnage determined by the controller 202 and dispensed from the dispenser 210 is insufficient to fill the void in the container 232. The manual dunnage dispensing input device 260 does not have to be a separate device, but can be the same device used as one or both of the manual input device 206 and the container characteristics input device 204.

An exemplary method for controlling an amount of dunnage to be dispensed to a packing container includes the steps of (i) manually selecting an input option from multiple discrete input options, where the input options represent estimates of relative degrees to which a container is filled by one or more products to be packaged, (ii) identifying one or more characteristics of a container, and (iii) providing an output signal indicating a quantity of dunnage to dispense to the container based on the selected input option and the one or more identified characteristics of the container. The providing step can include transmitting the output signal to a dunnage conversion machine or components thereof to convert a stock material into a dunnage product to dispense the determined quantity of dunnage.

The selecting step can be performed manually by at least one of speaking into a microphone, pressing a button, moving a toggle switch or rotary dial, typing on a keypad, pressing a foot switch or a knee switch, touching a touch screen display, moving a slider switch, and clicking a computer mouse, for example. Touching the touch screen display can include touching one or more areas of a touch screen display to select a discrete option, including selecting from a linear range of options. Likewise, the identifying step can include reading a bar code, reading a radio frequency identification tag (RFID tag), speaking into a microphone, sensing a dimension, pressing a button, moving a toggle switch or rotary dial, typing on a keypad, pressing a foot switch or a knee switch, and clicking a computer mouse, for example.

The selecting step can include selecting from about two to five discrete input options, or selecting an input option from a range of linear continuous input options. The selecting step can include selecting from discrete input options that include empty, 25% full, 50% full, 75% full, and full. Alternatively, the selecting step can include selecting from discrete input options that include nearly empty, half full, and nearly full. These examples are not meant to be exhaustive, and other devices and methods are contemplated for helping an inexperienced packer dispense an adequate amount of dunnage after estimating the relative degree of fullness of the container.

Figure 3:
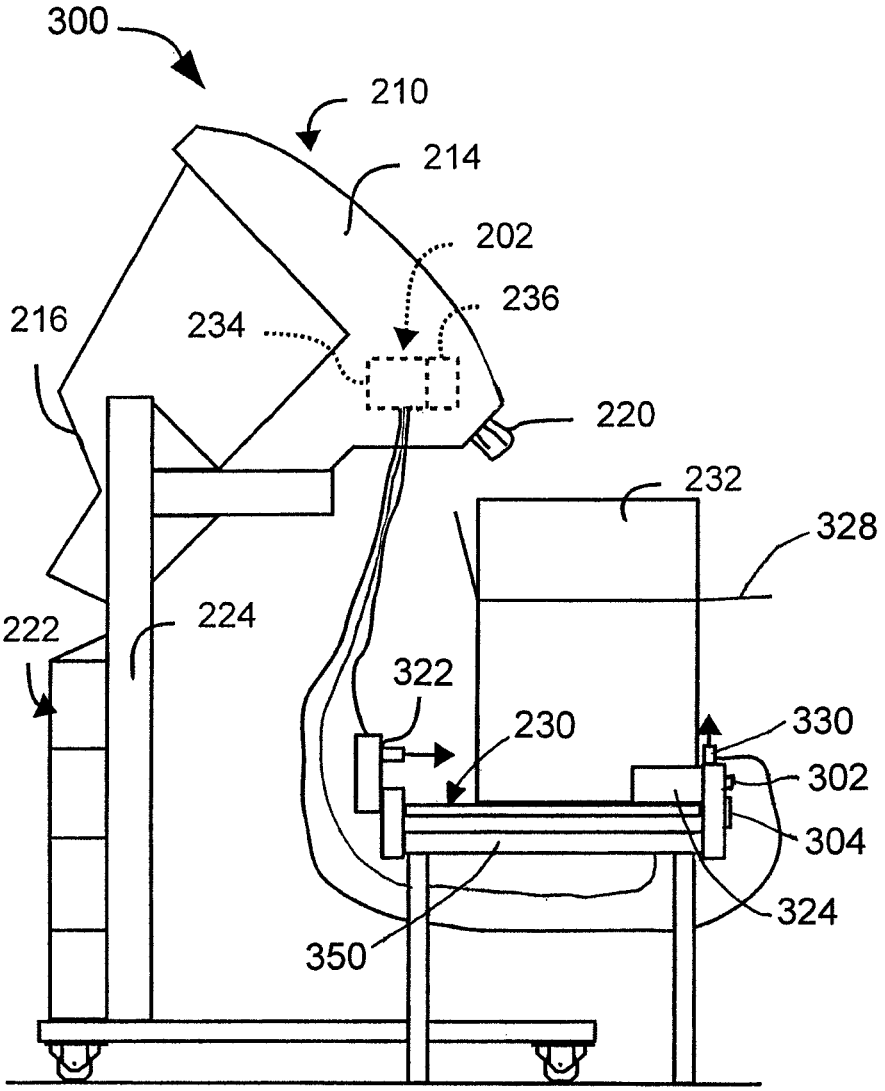
FIG. 3 is a schematic representation of a second exemplary packaging system provided in accordance with the present invention.
Figure 4:
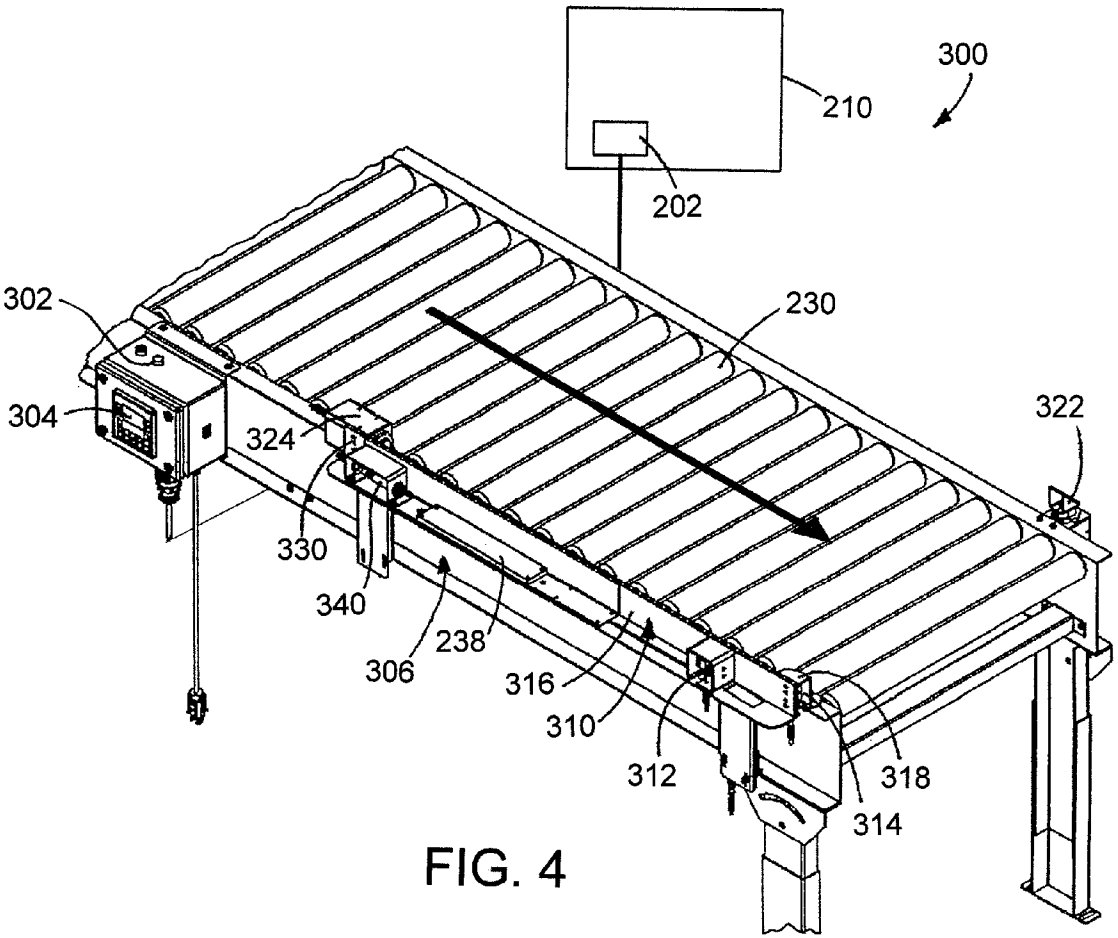
FIG. 4 is a partially schematic perspective view of a portion of the packaging system shown in FIG. 3.
Figure 5:
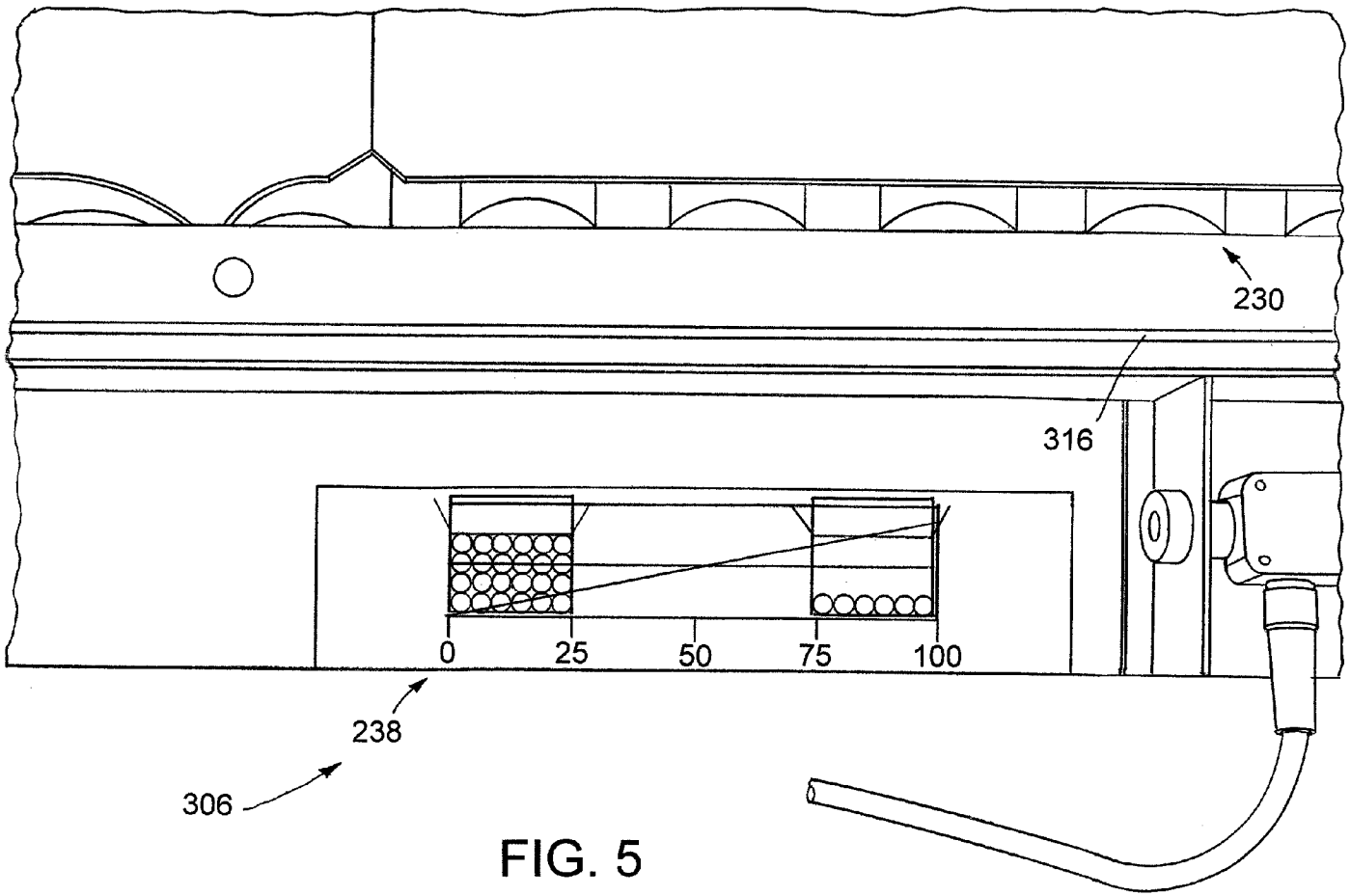
FIG. 5 is an enlarged schematic view of a manual input device used in the packaging system of FIG. 3.

A second exemplary embodiment of a system 300 provided by the present invention is shown in FIGS. 3-5. This alternative system 300 is similar to the previous embodiment, but includes a different type of device for the packer to indicate an estimated relative degree of fullness, and particular means for inputting the characteristics of a container, specifically means for measuring the dimensions of a container 232. As in the system 200 described above, this system 300 includes the controller 202 in communication with or incorporated into a dunnage dispenser 210 located at a packing station, as well as a manual input device 306 and means for determining container characteristics. The packing station includes a conveyor 230 for supporting a box or other container 232, particularly an RSC with one or more flaps that fold inwardly to close an open side of the container.

Unlike the previous embodiment, the manual input device 306 in this system 300 provides a continuous range of input options rather than several discrete input options for the estimated container fullness. Additionally, the means for determining the one or more container characteristics includes a plurality of sensors for determining length, width, and height dimensions of the container. Since the system 300 has many similar features in common with the previously described system 200, the common features are denoted by common reference numbers, and the description of this system 300 will focus on its operation rather than repeat descriptions of all of the common structural elements.

In this system 300, the controller 202 includes or is coupled to one or more outputs to communicate with the packer. For example, the controller 202 can output a signal to turn on a light 302, provide an output to a display 304, or otherwise signal that the system 300 is ready for a container 232. The controller 202 is therefore connected to an output device, such as a light, a display, a speaker, etc. A flashing green light, for example, can signal that the system 300 is ready for a container 232.

To begin using the system 300, the packer moves a container 232 into a packing position by registering one corner in a predetermined position at the packing station, where one or more sensors detect that the container is properly located. In this example, a locating bracket 310 at the packing station on the conveyor 230 forms an inside corner for receiving a corner of the container 232, and a pair of proximity sensors 312 and 314 are positioned on or adjacent the bracket 310 to detect two adjacent vertical sides of the container 232 that define the corner.

In the illustrated example, the locating bracket 310 includes a fence 316 generally parallel to and adjacent one side of the conveyor 230, and a protrusion 318 extending perpendicular from the fence 316. The proximity sensors 312 and 314 are mounted on each side of the bracket adjacent the fence 316 and the protrusion 318, respectively, to detect orthogonal sides of the container 232. Specifically, the fence side 316 of the bracket 310 extends generally parallel to the direction of the conveyor 230 on one side of the conveyor, and the protrusion side 318 of the bracket 310 extends generally perpendicular to the direction of the conveyor 230. When both proximity sensors 312 and 314 detect that the corresponding sides of the container 232 are both in position, the controller 202 signals that the corner of the container 232 is properly located in the packing position, such as by changing the flashing green light to a solid green light.

Sensors at known locations then measure distances from the sensors to orthogonal sides of the container. The controller 202 analyzes the signals from the sensors to determine the length and width of the container. Specifically, a width sensor 322 across the conveyor 230 from the fence side 316 of the locating bracket 310 measures a perpendicular distance across the conveyor 230 to an adjacent side of the container 232, from which measurement the controller 202 can determine the width of the container 232, and a length sensor 324 spaced along the conveyor 230 from the protrusion side 318 of the bracket 310 measures the distance parallel to the fence side 316 of the bracket 310 to an adjacent wall of the container 232, from which measurement the controller 202 can determine the length of the container.

To measure the approximate height of the container 232, the packer positions a flap 328 connected to a top edge of a side wall at an angle relative to the side wall, such as by folding the flap 328 nearest the packer, outwardly displacing a distal end of the flap, and typically down to a substantially horizontal orientation. A height sensor 330 directs a sensor beam parallel to the side wall toward the flap 328 to measure a vertical distance adjacent and parallel to the side wall and the fence side 316 of the locating bracket 310. The controller 202 can determine the approximate height of the container 232 based on this measurement. The controller 202 can provide a signal when the measuring step is complete, such as by turning on another light, outputting a sound from a speaker, etc.

The controller 202 either can use the determined dimensions directly or can compare one or more of the determined dimensions to a table stored in memory to determine, or in some cases confirm, the actual dimensions and/or the volume of the empty container. For example, the controller 202 can compare the approximate height to each height value stored in memory and select the closest actual height to the measured approximate height. The same is true of the measured width and length of the container 232, although those measurements probably are more accurate because the measurement is made to a fixed surface, rather than a movable flap. Since the flap 328 moves, it might not be perfectly horizontal when the sensor measures the distance to the flap. If the flap is not horizontal, the measured approximate height will be either less than or greater than the actual height of the container. In many cases the exact dimensions are not necessary, due to the compressible/expandable nature of the dunnage.

Consequently, the present invention also provides a system 300 for determining an approximate height dimension of a packing container 232 having a flap 328 secured to an upper edge of a side wall of the container. The system 300 includes (a) a registration device, such as the described bracket 310, against which a vertical side of a container can be registered, (b) a sensor 330 positioned adjacent the registration device to direct a sensor beam parallel to the side wall to measure a vertical distance from a known position to an outwardly-displaced flap 328 connected to an upper edge of a side wall of the container, and (c) a controller 202 for determining a height of the container based on the measured vertical distance.

Thus, the present invention also provides a method for determining a height dimension of a packing container 232 having a flap 328 secured to an upper edge of a side wall of the container, including the steps of positioning a flap at an angle relative to the corresponding side wall and directing a sensor beam parallel to the side wall to measure an approximate height dimension of the side wall. The sensor beam measures a vertical distance from a known position to the outwardly displaced flap 328 adjacent a side wall of the container, and the controller 202 can then determine a height of the container 232 based on the measured distance. The method also can include the steps of directing sensor beams from known locations perpendicular to orthogonal sides of the container to measure a width dimension and a length dimension of the container.

As mentioned above, in place of the height sensor 330, width sensor 322, and length sensor 324, the container size can be determined from a bar code or other indicia that either identify the container 232 or specify its size, and/or a look-up table stored in memory where the container size or empty container volume is known. In such a system, the controller 202 can determine the empty container volume from a look-up table stored in the memory 236 or by calculating the volume from container dimensions obtained from a look-up table stored in memory.

As in the previous embodiment, the packer then looks into the container 232 and determines how full the container is. The container 232 should already have one or more objects inside. If the container is empty, the packer will return the container to a packing area where objects to be shipped can be placed in the container. If the container is full, the packer might decide that there is no room to add dunnage to the container and the packer can send the container for closing and shipment without adding dunnage. If the packer notices that the container is full, the packer can send the container downstream without waiting for the measuring steps to be completed. In that case, the packer can reset the system 300 for the next container either by indicating that the container 232 is full via the manual input device 306 or by removing the container 232 from the packing location.

Once the packer determines how full the container 232 is, the packer can input the determined estimate of the relative degree of fullness. This is the equivalent to indicating, in terms of a relative degree of emptiness, how much volume needs to be filled with dunnage. From the measured container size or other determination of the empty container volume, the known dunnage volume, the input relative degree of fullness estimate, etc., the controller 202 can then determine the quantity of dunnage to dispense to fill the void in the container.

The packer manually inputs an estimated degree of fullness via the manual input device 306. A manual input includes any human-generated means for providing an input, whether by verbal command, human-operated device to generate an electrical signal, a sound, a touch, a hand gesture, hand position or orientation, etc. As in the previous system 200, the manual input device 306 includes an illustration 238 correlated with means for manually inputting an estimated relative degree of fullness. The illustration 238 includes indicia representing the range of options representing the degree of fullness in the container. The indicia can indicate a continuous range from empty to full or discrete options within that range.

The indicia provide a visual guide to help the packer select the appropriate relative amount of dunnage to dispense. For example, the indicia can include a visual representation of a full container, an empty container and/or one or more partially full containers. The packer can make a selection that most closely matches the fullness of the container within the available range. In addition, or as an alternative, an inclined scale can be provided for the range of dunnage that can be selected. The illustration 238 shown in FIG. 5, for example, includes such indicia as a representation of a right triangle, with the longest side indicating a continuum of degrees of fullness that can be selected, as well as representations of a full container, and a nearly empty container superimposed on or presented behind the triangle. The illustration also includes indicia that indicate an approximate degree of fullness as a numeric value, such as a percentage of the empty container volume, e.g., 25% filled, 50% filled, 75% filled, etc.

A touch panel or touch screen display is one way for the packer to input an estimate. The sensitivity of a monitor or other touch-sensitive device can be coarse or fine, depending on how close an estimate of degree of fullness is desired. A dunnage product that settles or compresses more does not need as precise a measurement as a less resilient or interlocking or otherwise less-settling dunnage product.

Figure 6:
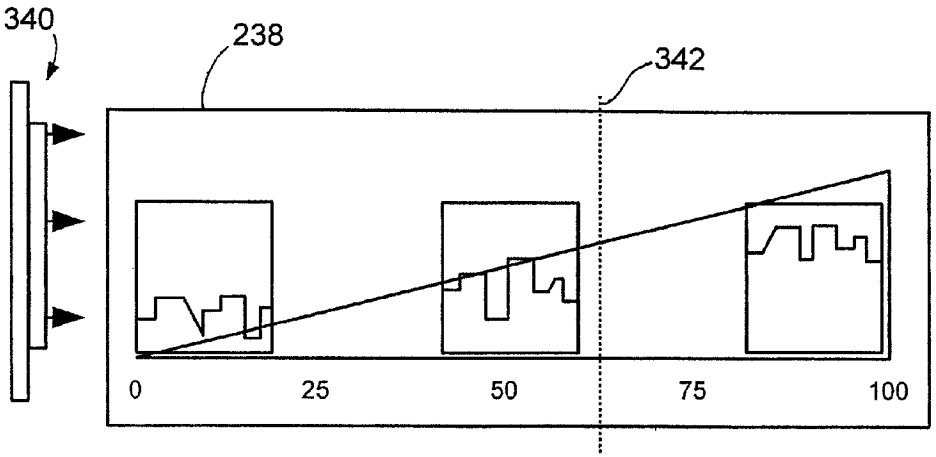
FIG. 6 is an enlarged view of alternative manual input device used in the packaging system of FIG. 3.
Figure 7:
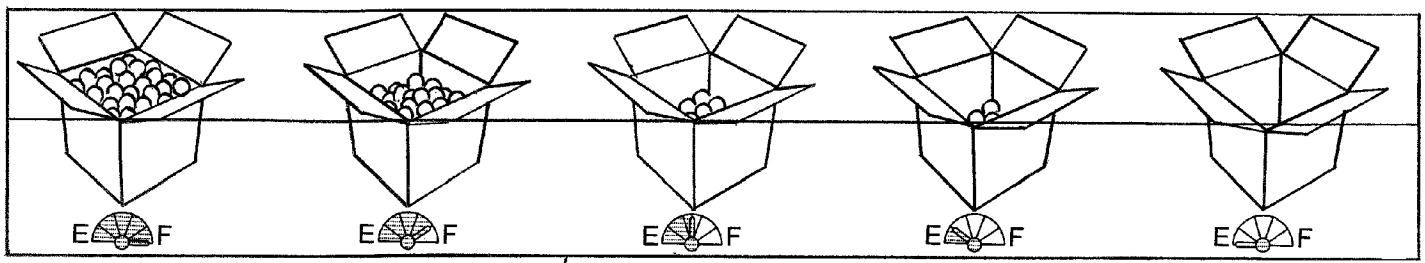
FIG. 7 is a plan view of an alternative illustration used in conjunction with a manual input device provided in accordance with the present invention.

In place of a touch-sensitive device, the manual input device 306 can include a fullness sensor 340 positioned to detect a body, such as the packer's hand or other pointing device, and measure its distance from the sensor 340. The distance is correlated to the relative degrees of fullness shown in the illustration 238. In FIG. 5, the sensor 340 is mounted to one side of the illustration 238 to measure the distance from the packer's hand to the sensor, where each position corresponds to an estimated degree of fullness indicated in the illustration. An alternative illustration 238 and sensor 340 is shown in FIG. 6, with a possible hand position indicated by line 342 at a container fullness of about 60%. Another alternative illustration is shown in FIG. 7. The controller 202 can determine the estimated amount of dunnage or degree of fullness based on that measured distance. The controller 202 then outputs a signal, such as a signal to control a dunnage dispenser 210, that indicates the appropriate amount of dunnage for that container.

Once the controller 202 determines the amount of dunnage needed, the controller 202 also can provide a signal indicating a readiness to dispense dunnage. For example, the flashing light 302 that indicates that the system 300 is ready for a container can change to a solid light to indicate that the container 232 is properly registered, has been measured, and is ready for dunnage.

If the packer decides that the container needs additional dunnage, with the container still in the packing position the packer can make another selection and the controller can control the dunnage dispenser 210 to dispense another quantity of dunnage. Alternatively, the packer can manually control the dunnage dispenser 210 using another input device, such as the foot pedal 260 (FIG. 1) described above, to dispense additional dunnage to the container. Since most dunnage products have some resiliency, slightly overfilling the container, while being an inefficient use of dunnage, generally does not compromise the ability to close the container and ship it to its destination.

When the container 232 is removed from the packing position, as detected by the proximity sensors 312 and 314, the system 300 resets and the controller 202 can signal that it is ready for another container by again flashing a light 302, for example.

Thus, the system 300 includes a device for controlling an amount of dunnage to be dispensed to a packing container with one or more objects, including a container input device 204 to identify one or more characteristics of a packing container, an illustration 238 of different degrees of fill for a container, a manual input device 206 for inputting an estimated degree of fullness of the packing container having one or more articles to be packed correlated with the illustration, and a controller 202 in communication with the container input device 204 and the manual input device 206 that determines the quantity of dunnage to dispense to the container based on the input estimated degree of fullness and the identified input container. The illustration 238 includes indicia representing at least two input options, and indicia representing a substantially continuous range of input options between empty and full.

Accordingly, a method for controlling an amount of dunnage to be dispensed to a packing container using this system 300 includes the steps of (i) identifying one or more characteristics of a container where one or more articles are placed in the container for packing, (ii) manually inputting an estimated degree of fullness for the container, and (iii) providing an output signal indicating a quantity of dunnage to dispense to the container based on the estimated degree of fullness and the one or more identified characteristics of the container.

The packing station also can include a scale 350 integral with or separate from the conveyor 230 for weighing the container 232. The weight of the container and its contents, the amount of dunnage dispensed, the container dimensions, etc., can be recorded and stored in memory for subsequent retrieval and/or analysis. This data can be stored or output in a format suitable for use in a common software data format, such as for a spreadsheet.

The controller 202 also can compare the weight of the container 232, including an estimated dunnage weight, to a schedule or table of shipping rates. In the schedule of shipping rates, also called freight weights, each rate in monetary units is associated with a range of weights, and typically includes higher freight rates for heavier containers. If a determined amount of dunnage needed to fill the void volume would move the container into a higher freight rate, the controller can output a signal to the operator that indicates a proposed reduced amount of dunnage that will reduce the freight or shipping rate. The tipping point where more dunnage would move the container into a higher shipping rate can be indicated to the packer, such as with a light or a display. The packer can then choose whether to dispense the reduced amount of dunnage or the full amount of dunnage based on the needs of the articles being shipped. More fragile articles generally would require the full amount of dunnage, for example.

In summary, the scale can be used to weigh each container before dunnage is added, after dunnage is added, while dunnage is added, or a combination thereof. Based on the measured weight, the determined dimensions, the predetermined dunnage quantity as a function of void volume, and the range of weights and corresponding shipping rates, the controller can determine both (i) the amount of dunnage to dispense and the resulting freight rate based on the total package weight, and (ii) a reduced amount of dunnage to dispense to reduce the total package weight to a lower freight rate. The controller 202 can provide an output to the packer that indicates the amount of dunnage to dispense where the total package weight will fall within the lower freight rate so that the packer can judge whether the reduction in dunnage would be sufficient to protect the objects being shipped. Then the packer can select from the presented options whether to produce the reduced amount of dunnage or the normal amount of dunnage.

As should be apparent from the description provided herein, the present invention provides a packaging system that an inexperienced packer can immediately operate and contribute to a company's packaging operation without requiring a lot of experience or training to do so effectively.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

We claim:

1. A void-fill packaging system comprising a manual input device for indicating to the system an estimate of how full a container is, a container input device to identify one or more characteristics of a packing container; and an illustration of different degrees of fill for a container; and an electronic controller that provides an output signal that indicates how much dunnage to dispense to the container based on the estimated fullness and one or more characteristics of the container;

where the manual input device includes a device for inputting an estimated degree of fullness of the packing container having one or more articles to be packed correlated with the illustration; and where the controller is in communication with the container input device and the manual input device, and determines the quantity of dunnage to dispense to the container based on the input estimated degree of fullness and the input container identity.

2. A system as set forth in claim 1, where the controller provides an output signal indicating a quantity of dunnage to dispense to the container based on a signal from the manual input device and a signal from the container input device.

3. A system as set forth in claim 1, where the illustration includes one or more of: (a) indicia representing at least two input options; and (b) indicia representing a substantially continuous range of input options between empty and full.

4. A system as set forth in claim 1 where the container input device includes or more of: (a) a sensor to indicate a dimension of a container; and (b) a scale to weigh a container at the packaging station, where the controller can compare the weight of the container to a freight rate schedule, to determine how much less dunnage should be dispensed to reach a lower freight rate and to output a signal representing the reduced amount of dunnage in addition to the output signal that indicates how much dunnage to dispense to the container based on the estimated fullness and the one or more characteristics of the container.

5. A system as set forth in claim 1, where the manual input device includes one or more of: (a) means for selecting a discrete input option from multiple input options representing relative degrees to which a container is filled by one or more products to be packaged; and (b) one or more of a position sensor, and one or more switches, to indicate the relative degree of fullness of the container; and (c) a variable fullness-level indicator with multiple input options between empty and full.

6. A system as set forth in claim 1, where the manual input device provides one or more of: (a) about two to about five discrete input options; (b) a range of input options between empty and full; (c) a substantially continuous range of input options between empty and full; and (d) input options that include empty, 25% full, 50% full, 75% full, and full.

7. A system as set forth in claim 1, comprising a dunnage dispenser in communication with the controller to dispense the indicated quantity of dunnage; where the dunnage dispenser includes one or more of: (a) a conversion machine that converts a stock material into a dunnage product; and (b) a dunnage dispensing input device to manually dispense dunnage.

8. A method for controlling an amount of dunnage to be dispensed to a packing container, comprising the steps of:

identifying one or more characteristics of a container where one or more articles are placed in the shipping container;

manually inputting an estimated degree of fullness for the container; and providing an output signal indicating a quantity of dunnage to dispense to the container based on the estimated degree of fullness and the one or more identified characteristics of the container;

where the manually inputting step includes selecting from about two to five discrete input options by positioning a body adjacent an illustration of an estimated degree of fullness so that the position of the body can be sensed, thereby indicating the selected input option corresponding to the illustration of the estimated degree of fullness of the container.

9. A method as set forth in claim 8, where the manually inputting step includes one or more of the following steps: (a) selecting from discrete input options that include empty, 25% full, 50% full, 75% full, and full; and (b) selecting from discrete input options that include nearly empty, half full, and nearly full.

10. A method as set forth in claim 8, comprising one or more of the following: (a) where the identifying step includes sensing one or more dimensions of a container; (b) the step of dispensing the indicated quantity of dunnage based on the output signal; (c) the step of determining an empty volume of the container based on the identified characteristics of the container; (d) the step of determining a void volume of the container based on the determined empty volume of the container and the estimated relative degree of fullness of the container; and (e) the step of manually dispensing a quantity of dunnage.

11. A method as set forth in claim 8, where the providing step includes one or more of the following steps: (a) transmitting the output signal to a dunnage dispenser to dispense the indicated quantity of dunnage; and (b) transmitting the output signal to a dunnage conversion machine to convert a stock material into a dunnage product to dispense the indicated quantity of dunnage.

* * * * *